US007046955B2

(12) United States Patent
Hatanaka et al.

(10) Patent No.: US 7,046,955 B2
(45) Date of Patent: May 16, 2006

(54) IMAGE FORMING APPARATUS

(75) Inventors: Masatsugu Hatanaka, Kashiwara (JP); Kayo Kamei, Yamatokoriyama (JP); Yoshiaki Hiramoto, Yamatokoriyama (JP); Seiichi Kizu, Ikoma (JP); Yasushi Matsutomo, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/767,635

(22) Filed: Jan. 28, 2004

(65) Prior Publication Data

US 2004/0184855 A1 Sep. 23, 2004

(30) Foreign Application Priority Data

Feb. 4, 2003 (JP) ..... P2003-027367

(51) Int. Cl.
*G03G 15/00* (2006.01)

(52) U.S. Cl. ..... 399/405; 399/107; 399/110

(58) Field of Classification Search ..... 399/405, 399/107, 110, 393
See application file for complete search history.

(56) References Cited

U.S. PATENT DOCUMENTS

| | | | | |
|---|---|---|---|---|
| 4,157,059 | A * | 6/1979 | Schultes et al. | 211/50 |
| 5,342,034 | A * | 8/1994 | Mandel et al. | 270/58.08 |
| 5,513,839 | A * | 5/1996 | Green | 270/58.07 |
| 5,590,871 | A * | 1/1997 | Okabe et al. | 270/58.27 |
| 5,839,025 | A * | 11/1998 | Okauchi et al. | 399/92 |
| 5,920,758 | A * | 7/1999 | Ohtsuki | 399/405 |
| 6,449,459 | B1 * | 9/2002 | Tamehira et al. | 399/405 |
| 6,473,591 | B1 * | 10/2002 | Kominato | 399/405 |
| 6,690,901 | B1 * | 2/2004 | Katsuyama et al. | 399/107 |
| 6,725,011 | B1 * | 4/2004 | Sato | 399/405 |
| 6,728,511 | B1 * | 4/2004 | Watanabe | 399/405 |
| 6,771,917 | B1 * | 8/2004 | Kaiho | 399/92 |
| 2004/0096237 | A1 * | 5/2004 | Asai | 399/107 |
| 2004/0234292 | A1 * | 11/2004 | Sato et al. | 399/107 |

FOREIGN PATENT DOCUMENTS

| | | |
|---|---|---|
| JP | 5-186121 | 7/1993 |
| JP | 8-208091 | 8/1996 |
| JP | 10-301349 | 11/1998 |
| JP | 11-199124 | 7/1999 |
| JP | 2000-86056 | 3/2000 |

* cited by examiner

*Primary Examiner*—Ren Yan
*Assistant Examiner*—Dave A. Ghatt
(74) *Attorney, Agent, or Firm*—David G. Conlin; Steven M. Jensen; Edwards Angell Palmer & Dodge, LLP

(57) ABSTRACT

A front access type image forming apparatus includes an image scanning section located at an upper part of a housing of the apparatus for obtaining image information from an original, a sheet feeding section located at a lower part of the housing, and an image forming section disposed between the image scanning section and the sheet feeding section at one side of the housing. The image scanning section, the image forming section and the sheet feeding section together form a generally U shape in frontal cross section, a sheet delivery portion being formed between the image scanning section and the sheet feeding section. The length of a sheet delivery tray as measured along a sheet transport direction is made smaller than the length of a maximum printable sheet size so that large-sized printed sheets discharged onto the sheet delivery tray stick out from one side of the apparatus.

3 Claims, 7 Drawing Sheets

IMAGE FORMING APPARATUS

CROSS REFERENCE

This Nonprovisional application claims priority under 35 U.S.C. § 119(a) on Patent Application No. 2003-027367 filed in Japan on Feb. 4, 2003, the entire contents of which are hereby incorporated by reference.

BACKGROUND OF THE INVENTION

The present invention relates to a sheet delivery mechanism of a front access type image forming apparatus which allows user access to an internal space of the apparatus from the front thereof.

When multiple copies of an original document are printed by a conventional image forming apparatus, it is usually difficult for a user to discern boundaries between the individual copies of printed sheets (such as a boundary between a last page of a first copy and a first page of a second copy) discharged onto a sheet delivery tray and, therefore, the user is forced to undertake a tedious sorting task of manually separating the individual copies from one another.

To overcome this inconvenience, the prior art proposes various kinds of sheet delivery mechanisms featuring a shifter function which enables a user to distinctly discern boundaries between multiple copies (prints) of a multiple-page document. Arrangements for realizing the shifter function are roughly divided into three types.

(a) A first arrangement is to feed printing paper in different orientations (portrait and landscape) and rotate printed images clockwise and counterclockwise by 90 degrees for every other copy of a document as proposed in Japanese Laid-open Patent Publication No. 1999-199124, for example.

(b) A second arrangement is to use a movable sheet delivery tray (offset tray) which is shifted (offset) to different positions when receiving multiple copies of printed sheets ejected from a fixed sheet output position as proposed in Japanese Laid-open Patent Publication No. 2000-86056, for example.

(c) A third arrangement is to vary the sheet delivery position by shifting (offsetting) printed sheets being discharged by sheet output rollers provided in a sheet delivery section as proposed in Japanese Laid-open Patent Publication Nos. 1993-186121 and 1996-208091, for example.

Recently proposed to meet a growing demand for compact design are front access type image forming apparatuses which allow user access to an internal space of the apparatus from the front thereof. Many of this type of image forming apparatuses are designed such that an image scanning section is located at an upper part of the apparatus, a sheet feeding section is located at a lower part of the apparatus, and an image forming section is disposed between the image scanning section and the sheet feeding section at one side of the apparatus, in which the image scanning section, the image forming section and the sheet feeding section are arranged generally in a U shape in front view.

To meet also an increasing demand for advanced features, the front access type image forming apparatus incorporates a duplex (double-sided) image-forming function which is realized by a switchback paper transfer method instead of a normally used intermediate tray method. In the switchback paper transfer method, a sheet of paper is reversed by transferring the sheet in a direction opposite to an ordinary sheet transport direction immediately after an image has been formed on one side of the sheet.

For the front access type image forming apparatus, it is not desirable to employ the aforementioned first arrangement (a) of Japanese Laid-open Patent Publication No. 1999-199124. This is because it is necessary to provide multiple paper cassettes for each paper size to feed the printing paper in different orientations and this makes it difficult to achieve compactness of the apparatus. The aforementioned second arrangement (b) of Japanese Laid-open Patent Publication No. 2000-86056 is not desirable for the front access type image forming apparatus either, because it is difficult to accommodate the offset tray in a limited space available in a central empty space of a generally U-shaped structure (in cross section) of the apparatus.

In contrast, the aforementioned third arrangement (c) proposed in Japanese Laid-open Patent Publication Nos. 1993-186121 and 1996-208091, in which the printed sheets discharged by the sheet output rollers provided in the sheet delivery section are offset to shift the sheet delivery position, seems to be suited to the front access type image forming apparatus since its sheet delivery tray need not be moved like the offset tray without causing much hindrance to compact design.

When this third arrangement is employed, however, the user who gains access to the sheet delivery tray from the front of the apparatus can not visually watch the whole area of the sheet delivery tray, because the sheet delivery tray is located in a central empty space of the apparatus. Therefore, when removing sorted copies of printed sheets from the sheet delivery tray, the user may grasp an improper part of the printed sheets, inadvertently mixing up the already sorted copies.

SUMMARY OF THE INVENTION

In view of the foregoing, it is an object of the invention to provide a sheet delivery mechanism which makes it possible to reduce the width of an image forming apparatus and allows a user to easily remove even large-sized sheets from a sheet delivery tray by offering good visibility of printed sheets discharged onto the tray from a side of the apparatus.

According to the invention, an image forming apparatus includes an image scanning section located at an upper part of a housing of the apparatus for scanning an original to obtain image information therefrom, a sheet feeding section located at a lower part of the housing for feeding sheets used for image forming, and an image forming section disposed between the image scanning section and the sheet feeding section at one side of the housing. The image scanning section, the image forming section and the sheet feeding section are arranged generally in a U shape in cross section in the housing, a sheet delivery portion being formed in an inner empty space of the housing just between the image scanning section and the sheet feeding section. The length (L1) of the sheet delivery portion as measured along a sheet transport direction is made smaller than the length (L2) of a maximum printable sheet size.

In this image forming apparatus of the invention, large-sized printed sheets discharged onto the sheet delivery portion (sheet delivery tray) stick out from one side thereof because the length (L1) of the sheet delivery tray is made smaller than the length (L2) of the maximum printable sheet size. This construction makes it possible to reduce the width of the apparatus, contributing thereby to achieving compact design of the apparatus.

Even when the printed sheets are large enough to stick out from the side of the sheet delivery tray, a user can easily remove sorted copies of the printed sheets by grasping their sticking portion of the printed sheets from the side of the sheet delivery tray while clearly observing the discharged printed sheets with own eyes.

According to one feature of the invention, one side and the front of the inner empty space of the sheet delivery portion contiguously open to the exterior of the apparatus.

In the earlier-mentioned front access type image forming apparatus of the prior art, the inner empty space of its housing is covered by a side wall located in a sheet output direction, so that a user can access the sheet delivery tray only from the front of the apparatus. This means that the user has no alternative but to remove printed sheets from the front of the apparatus and, therefore, there must be a sufficient space above the sheet delivery tray to accommodate sheets of the maximum printable sheet size. This structural limitation would cause hindrance to compact design in conventional front access type image forming apparatuses.

In the image forming apparatus of the invention, however, the sheet delivery tray has a small length in the sheet output direction and the space above the sheet delivery tray contiguously opens to the exterior on both front and side of the apparatus without the provision of any side wall or pillar. Therefore, the user can clearly observe printed sheets discharged onto the sheet delivery tray from the front and side of the apparatus. This construction allows the user to easily remove small- and medium-sized printed sheets discharged onto the sheet delivery tray from either the front or side of the apparatus while observing the printed sheets, thereby offering enhanced ease of operation.

When printed sheets discharged onto the sheet delivery tray are large-sized, on the other hand, leading edges of the sheets stick out to the exterior from the side of the sheet delivery portion, so that the user can easily observe the sheets from the front of the apparatus and remove the sheets from the side (or front) of the sheet delivery tray.

According to another feature of the invention, the image forming apparatus further includes a shifter mechanism incorporating sheet output rollers which are used as offset rollers for offsetting printed sheets along a direction perpendicular to the sheet transport direction to selectively discharge the printed sheets to different sheet delivery positions on the sheet delivery portion.

The shifter mechanism of the image forming apparatus thus constructed offsets the printed sheets perpendicularly to the sheet transport direction by means of the sheet output rollers (offset rollers). In this construction, the provision of the shifter mechanism does not cause any hindrance to achieving compact design of the apparatus. In addition, the user can easily observe and remove sorted copies of the printed sheets without accidentally mixing up the already sorted copies.

According to still another feature of the invention, the sheet delivery portion is shaped to form a generally horizontal sheet receiving surface extending in a direction perpendicular to the sheet output direction.

In this construction, a top surface of the sheet delivery tray (sheet delivery portion) is shaped to form a generally horizontal sheet receiving surface extending perpendicularly to the sheet transport direction. Therefore, even if large-sized sheets offset by the aforementioned shifter mechanism are discharged onto the sheet delivery tray, partially stick out from the sheet delivery portion, sorted copies of the sheets can be loaded on the sheet delivery tray in a stable fashion. The top surface of the sheet delivery tray may be shaped to extend slightly upslope in the sheet output direction or to form an inverted V shape having upslope and downslope portions, for example.

Other features and advantages of the present invention will be more readily understood from the following detailed description when read in conjunction with accompanying drawings.

DETAILED DESCRIPTION OF THE INVENTION

The invention is now described in detail with reference to the accompanying drawings.

Image Forming Apparatus

Figure 1:
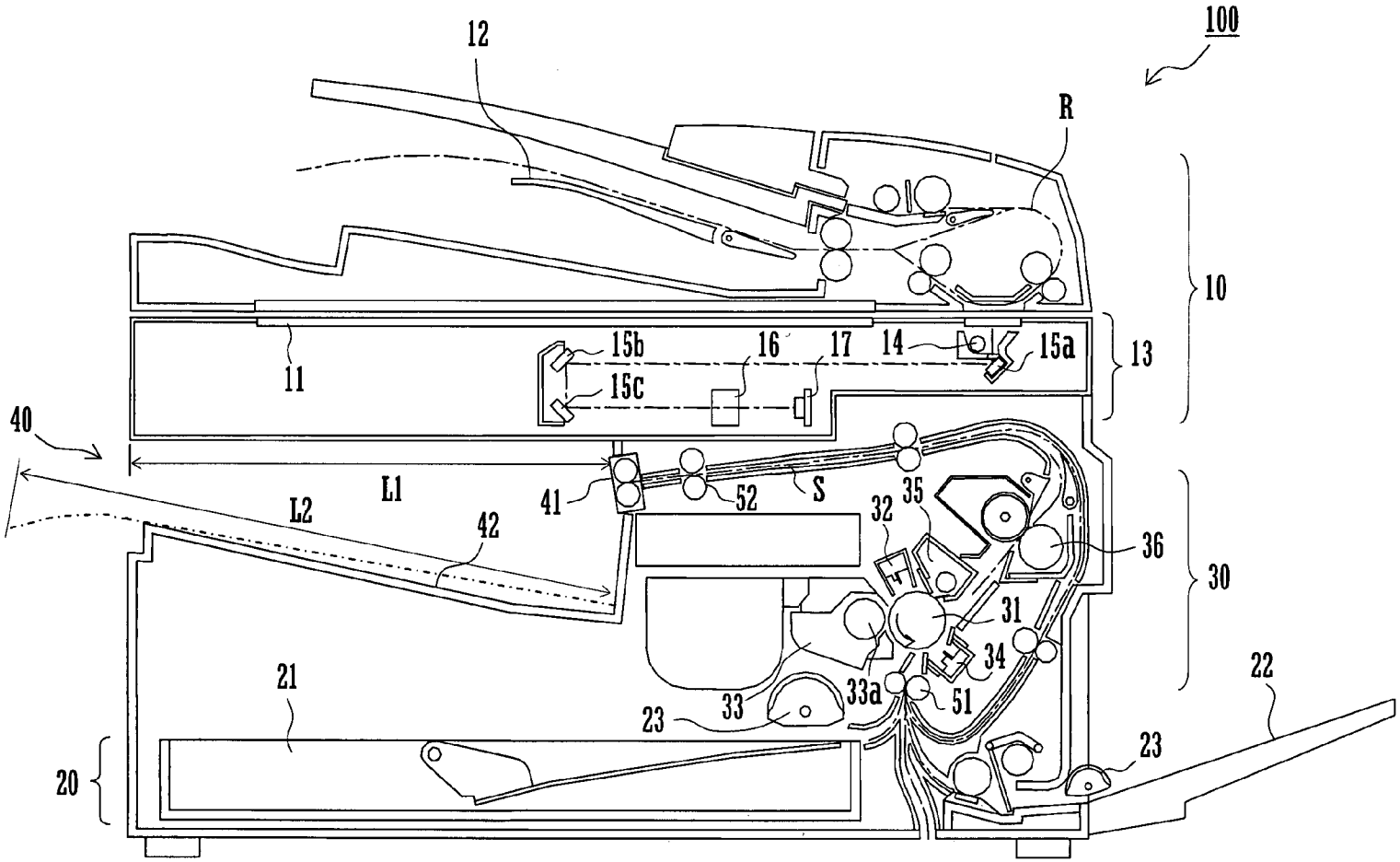
FIG. 1 is a sectional view showing the construction of an image forming apparatus according to a preferred embodiment of the invention.
Figure 2:
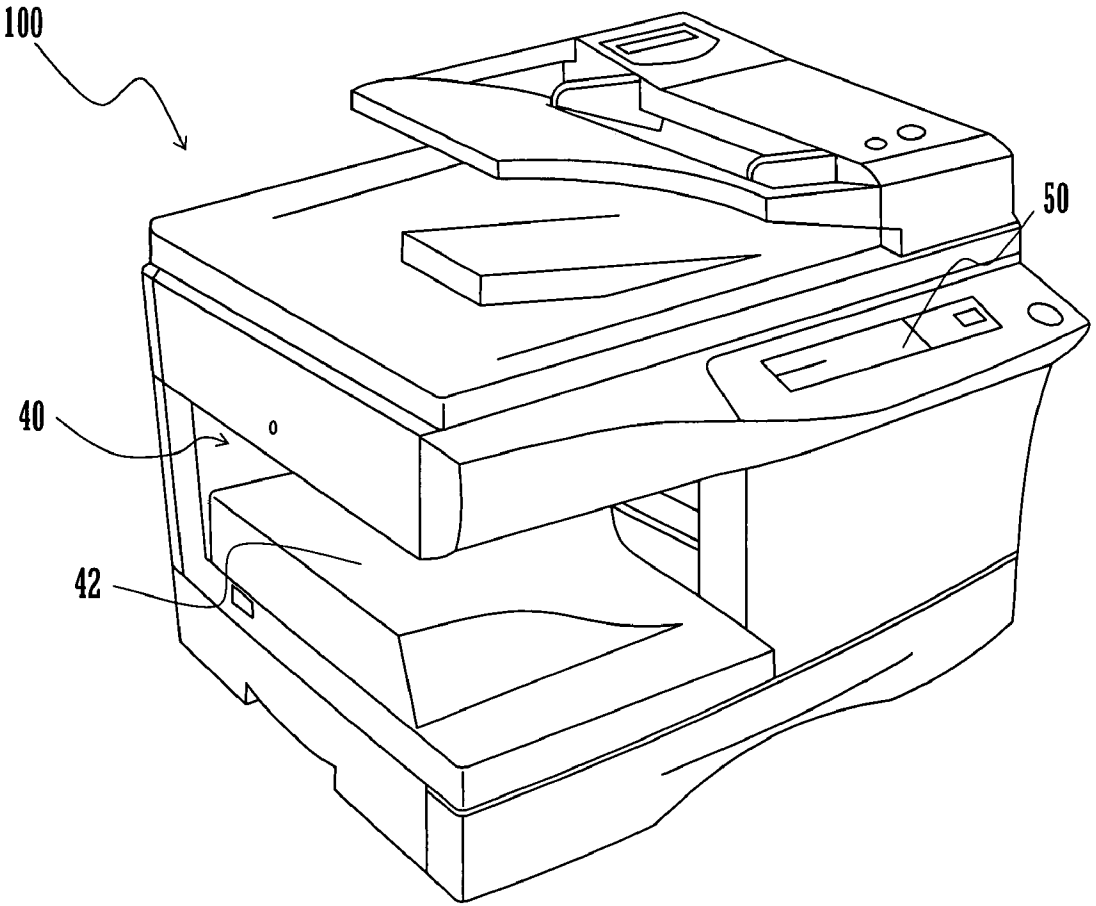
FIG. 2 is a perspective view showing the external appearance of the image forming apparatus.

FIG. 1 is a sectional view showing the construction of an image forming apparatus 100 according to a preferred embodiment of the invention, and FIG. 2 is a perspective view showing the external appearance of the image forming apparatus 100. As shown in these Figures, the image forming apparatus 100 includes an image scanning section 10, a sheet feeding section 20, an image forming section 30, a sheet delivery section 40 and an operator panel 50. The image forming apparatus 100 allows user choice of multiple image forming modes, that is, copier mode, printer mode and facsimile mode. In any of these image forming modes, the image forming apparatus 100 forms images on sheets of paper (or any other types of printing media, such as films for an overhead projector).

The image scanning section 10 located at an upper part of a housing of the apparatus 100, the paper feed section 20 located at a lower part of the housing and the image forming section 30 disposed between the image scanning section 10 and the paper feed section 20 at one side of the housing together form a U-shaped structure in frontal cross section. The sheet delivery section 40 is located in an inner empty space of the housing just between the image scanning section 10 and the sheet feeding section 20.

As can be seen from FIG. 2, the sheet delivery section 40 has continuous front and side openings to offer increased visibility of the inside of the sheet delivery section 40. When a large-sized sheet is discharged, the side opening allows a leading edge of the sheet to stick out to the exterior so that the sheet can be easily removed through either the front or side opening with improved convenience of handling.

The image scanning section 10 located at the upper part of the housing of the image forming apparatus 100 includes a platen glass 11, an original loading tray 12 and an optical scanning system 13. The optical scanning system 13 incorporates a light source 14, multiple reflecting mirrors 15*a*, 15*b*, 15*c*, an optical lens 16 and a charge-coupled device (CCD) 17.

The light source 14 emits light onto an original placed on the platen glass 11 or an original being transferred from the original loading tray 12 through an original transport path R. The multiple reflecting mirrors 15*a*, 15*b*, 15*c* successively reflect light reflected from the original to guide the reflected light to the optical lens 16. The optical lens 16 converges the reflected light guided by the reflecting mirrors 15*a*, 15*b*, 15*c* onto the CCD 17 which performs a photoelectric conversion process to convert the reflected light into an electric signal.

The sheet feeding section 20 located at the lower part of the housing of the image forming apparatus 100 includes a sheet cassette 21, a manual feed tray 22 and pickup rollers 23. Sheets are fed from the sheet cassette 21 or the manual feed tray 22 during image forming operation. The pickup rollers 23 individually provided to the sheet cassette 21 and the manual feed tray 22 rotate to feed each sheet from the sheet cassette 21 or the manual feed tray 22 into a sheet transport path S.

The image forming section 30 is located beneath the image scanning section 10 at one side of the housing of the image forming apparatus 100 where the manual feed tray 22 is located. The image forming section 30 includes a laser scanning unit (hereinafter referred to as the LSU), a photosensitive drum 31 and a fuser unit 36. The image forming section 30 further includes a charging unit 32, a developing unit 33, an image transfer unit 34 and a discharging unit 35 which are disposed in this order around the photosensitive drum 31 in a rotating direction of the photosensitive drum 31 shown by an arrow in FIG. 1. The operator panel 50 has a plurality of input keys (not shown) which accept various settings, such as the number of copies and a printing scale factor, entered by a user.

The sheet delivery section 40 located above the sheet cassette 21 includes an output sheet shifter mechanism 41 and a sheet delivery tray 42 serving as a sheet delivery portion. The output sheet shifter mechanism 41 discharges sheets carrying printed images from the sheet transport path S to offset positions on the sheet delivery tray 42. The sheet delivery tray 42 receives the individual sheets output by the output sheet shifter mechanism 41. The output sheet shifter mechanism 41 will be later described in greater detail.

When copying original images on sheets in the copier mode, the user places an original to be copied on the platen glass 11 or on the original loading tray 12 of the image scanning section 10. Then, the user sets the number of copies and a printing scale factor, for instance, by pressing appropriate input keys on the operator panel 50 and presses a start key (not shown).

When the start key is pressed, the image forming apparatus 100 causes the pickup roller 23 of the sheet cassette 21 or the manual feed tray 22 to rotate to feed a sheet therefrom into the sheet transport path S. The sheet is first fed up to registration rollers 51 disposed on the sheet transport path S. The registration rollers 51 nip a leading edge of the sheet located at a forwardmost extremity in a sheet transport direction so that a sub-scanning direction of the sheet becomes parallel to an axial direction of the registration rollers 51 and a toner image formed on the photosensitive drum 31 correctly aligns with the sheet when transferred thereto.

Image data picked up by the image scanning section 10 is subjected to an image processing process performed under conditions set by user input keys, for instance, and transmitted to the LSU as print data. An outer surface of the photosensitive drum 31 is uniformly charged to a specific potential by the charging unit 32. The LSU forms an electrostatic latent image of the original image on the surface of the photosensitive drum 31 by projecting laser light based on the image data (print data) by means of a polygon mirror and various lenses which are not illustrated.

Subsequently, toner adhering to an outer surface of a toner drum 33*a* of the developing unit 33 with part of the toner drum 33*a* directly facing the photosensitive drum 31 is attracted to the surface of the photosensitive drum 31 according to a distribution of charged and uncharged areas on the surface of the photosensitive drum 31. As a result, the latent image is converted into a visual toner image.

Then, the sheet nipped by the registration rollers 51 is passed through a gap between the photosensitive drum 31 and the image transfer unit 34 at correct registration with the toner image.

While the sheet is being transported, the toner image is transferred from the surface of the photosensitive drum 31 onto the sheet by an image transfer roller 34*a* provided in the image transfer unit 34. Residual toner left on the surface of the photosensitive drum 31 is scraped off by a cleaning blade of a drum unit (not shown) and collected by a cleaner unit (not shown). The sheet carrying the transferred toner image is passed through an upper heat roller 36*a* and a lower heat roller 36*b* provided in the fuser unit 36. Heat and pressure applied by the upper and lower heat roller 36*a*, 36*b* fuse and fix the toner image onto the sheet. The sheet is then delivered to the sheet delivery tray 42 by the output sheet shifter mechanism 41.

Sheet Delivery Mechanism—Output Sheet Shifter Mechanism

Figure 3:
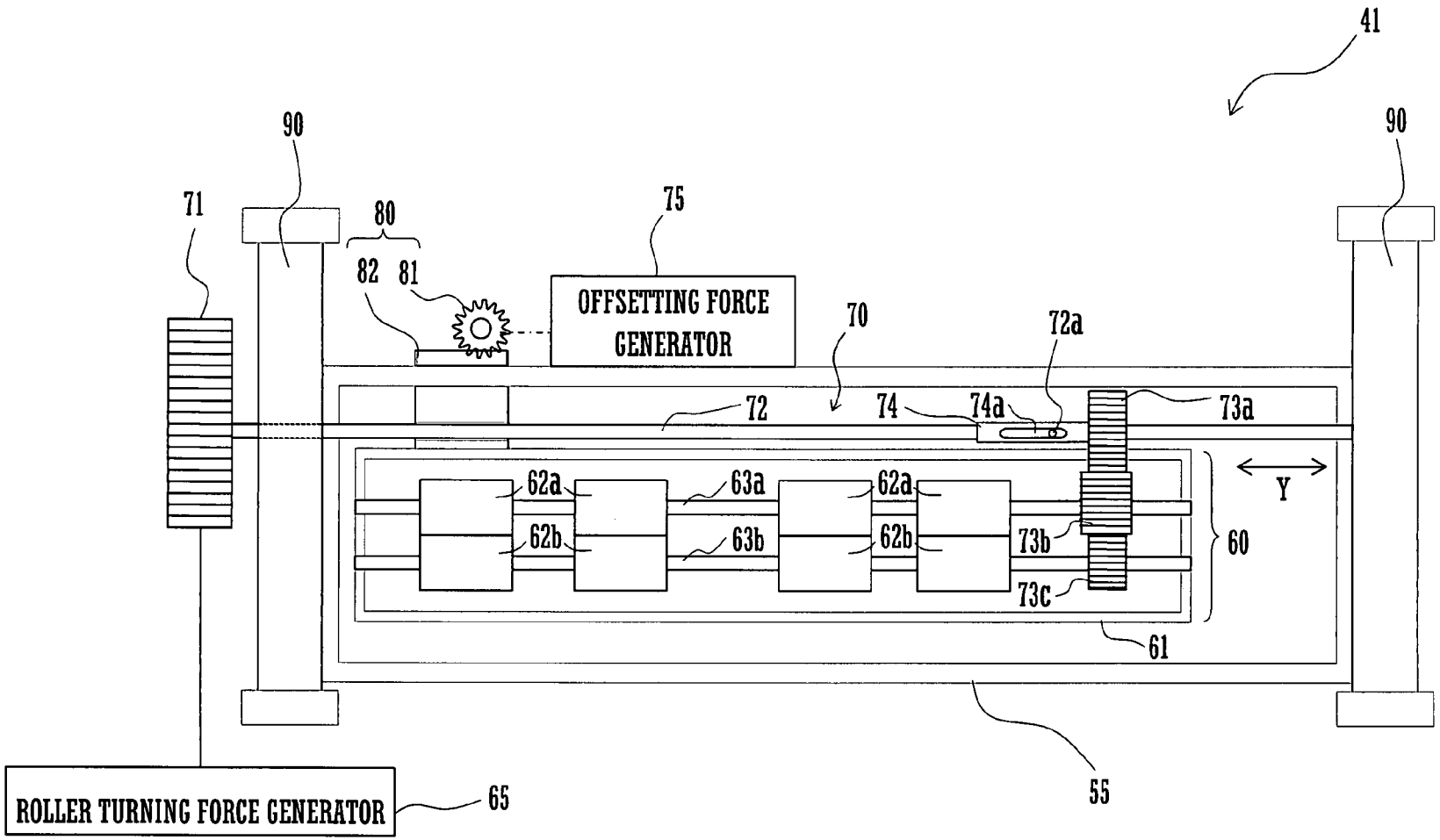
FIG. 3 is a sectional side view showing the construction of an output sheet shifter mechanism built in the image forming apparatus.
Figure 4:
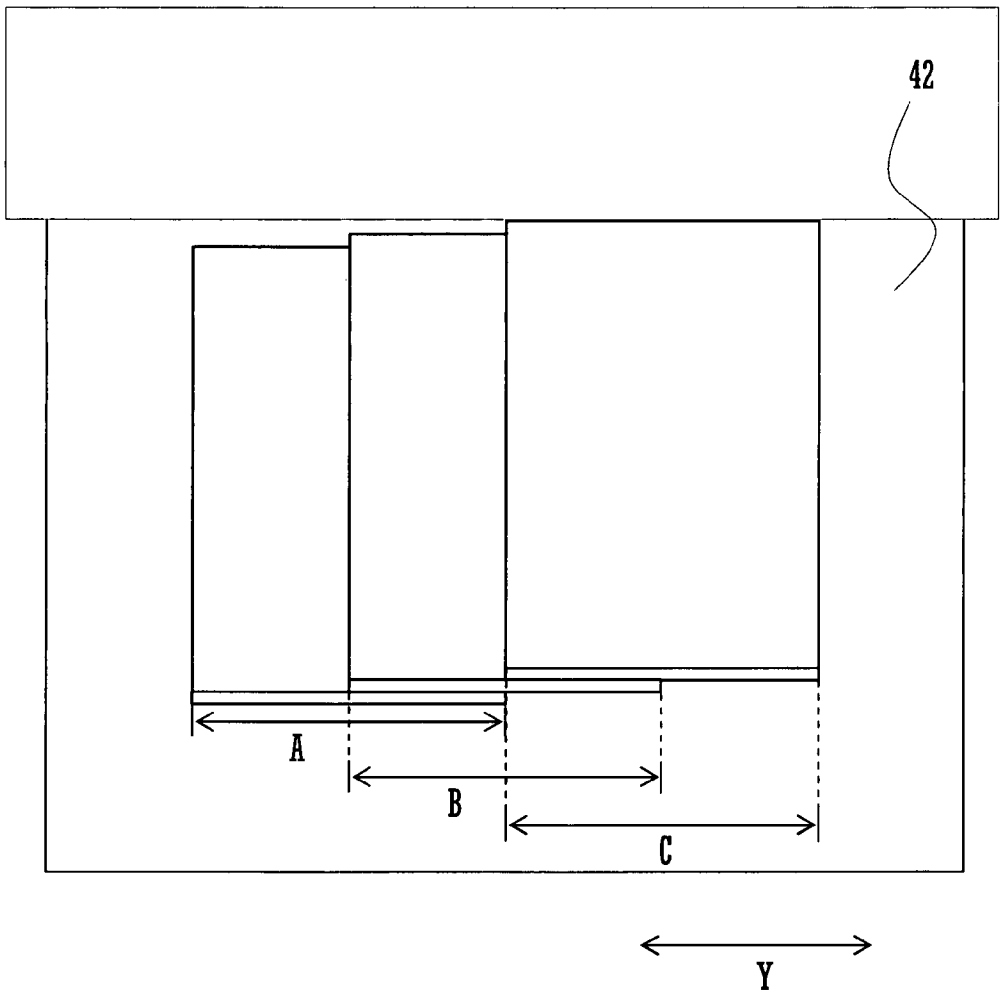
FIG. 4 is a diagram showing offset delivery positions on a sheet delivery tray where the image forming apparatus delivers printed sheets with the output sheet shifter mechanism.

FIG. 3 is a sectional side view showing the construction of the output sheet shifter mechanism 41 (sheet delivery mechanism) of the present embodiment. The output sheet shifter mechanism 41 includes an enclosure 55, an offset unit 60, a roller turning force generator 65, a driving force transmission mechanism 70, an offsetting force generator 75 and an offsetting force transmission mechanism 80. If the user has entered a setting for activating a sorting function by pressing appropriate input keys on the operator panel 50, the output sheet shifter mechanism 41 selectively delivers printed sheets to varying positions on the sheet delivery tray 42 by successively shifting the individual sheets along the direction of an arrow Y shown in FIG. 4, perpendicularly to the sheet transport direction. If the user has entered a setting for activating a sorting function by pressing appropriate input keys on the operator panel 50, the output sheet shifter mechanism 41 selectively delivers printed sheets to varying positions on the sheet delivery tray 42 by successively shifting the individual sheets along the direction of an arrow Y shown in FIG. 4, perpendicularly to the sheet transport direction. More specifically, the output sheet shifter mechanism 41 delivers a first sheet to a normal (reference) delivery position A, a second sheet to a delivery position B offset in a direction perpendicular to the sheet transport direction along the direction of the arrow Y, and a third sheet to a delivery position C further offset along the direction of the arrow Y as illustrated.

The enclosure 55, which is supported by a frame 90 of the housing of the image forming apparatus 100, incorporates the offset unit 60 and part of the driving force transmission mechanism 70 in an internal space and is fitted with the offsetting force generator 75 and the offsetting force transmission mechanism 80 disposed on the outside. The offset unit 60, which includes an internal enclosure 61 and a pair of upper and lower offset roller assemblies 62 rotatably supported in the internal enclosure 61, shifts along the direction of the arrow Y from a position shown in FIG. 3, for example, to selectively output the printed sheets to the individual delivery positions A, B, C.

The internal enclosure 61 rotatably supports the individual offset roller assemblies 62 so that the offset roller assemblies 62 can push out the printed sheets in the sheet transport direction. The offset roller assemblies 62 carry multiple pairs of upper and lower rollers 62*a*, 62*b* as illustrated. These rollers 62*a*, 62*b* rotate while nipping each sheet to deliver it onto the sheet delivery tray 42.

The roller turning force generator 65 produces a driving force for turning the offset roller assemblies 62 via the driving force transmission mechanism 70. The driving force transmission mechanism 70, which includes a driving gear 71, a shaft 72, connecting gears 73*a*, 73*b*, 73*c* and a sliding sleeve 74, transmits the driving force of the roller turning force generator 65 to the offset roller assemblies 62. Mounted directly on the shaft 72, the driving gear 71 connected to the roller turning force generator 65 turns the shaft 72.

The shaft 72 is rotatably supported in the frame 90 of the housing. Mounted on the shaft 72, the sliding sleeve 74 is made slidable along the shaft 72. Also, the shaft 72 supports the offset unit 60 via the sliding sleeve 74 and the connecting gears 73*a*, 73*b*, 73*c* movably along the direction of the arrow Y (FIG. 3) which is perpendicular to the sheet transport direction. The shaft 72 has a stopper pin 72*a* for limiting a movable range of the offset unit 60 and the accompanying connecting gears 73*a*, 73*b*, 73*c*. The stopper pin 72*a* limits a movable range of the sliding sleeve 74, or the movable range of the offset unit 60 and the accompanying connecting gears 73*a*, 73*b*, 73*c*, as the stopper pin 72*a* projects outward through a slotted hole 74*a* formed in the sliding sleeve 74, the slotted hole 74*a* extending along an axial direction of the sliding sleeve 74. The stopper pin 72*a* also transmits rotary motion of the shaft 72 to the sliding sleeve 74, so that the offset roller assemblies 62 rotate when the shaft 72 rotates.

The three connecting gears 73*a*, 73*b*, 73*c* are meshed together with the connecting gear 73*b* placed between the gears 73*a* and 73*c*. The connecting gear 73*a* protrudes from the internal enclosure 61 through an opening formed therein on a side of the internal enclosure 61 facing the shaft 72. The connecting gear 73*a* thus protruding is fitted on the sliding sleeve 74 and supported thereby, so that the connecting gear 73*a* is slidable over the shaft 72 along the direction of the arrow Y together with the sliding sleeve 74. When the shaft 72 rotates, its rotary motion is transmitted to the connecting gear 73*a* via the stopper pin 72*a* of the shaft 72. Therefore, the shaft 72, the sliding sleeve 74 and the connecting gear 73*a* together rotate as a single piece.

The connecting gear 73*b* is fitted on one end of a shaft 63*a* supporting the rollers 62*a* of the upper offset roller assembly 62, whereas the connecting gear 73*c* is fitted on one end of a shaft 63*b* supporting the rollers 62*b* of the lower offset roller assembly 62. As the gears 73*b* and 73*c* turn in opposite directions, the upper rollers 62*a* and the lower rollers 62*b* turn in such a way that their contact portions (nip areas) correctly push out each sheet in the aforementioned sheet transport direction.

The offsetting force generator 75 connected to the offsetting force transmission mechanism 80 produces a driving force for shifting the offset unit 60 along the direction of the arrow Y (FIG. 3). The offsetting force transmission mechanism 80 includes a pinion 81 and a rack 82. When driven by the offsetting force generator 75, the pinion 81 rotates and causes the rack 82 to move in the direction of the arrow Y, whereby the internal enclosure 61 to which the rack 82 is affixed shifts in the same direction. Consequently, a sheet nipped between the upper and lower rollers 62*a*, 62*b* is discharged to one of the delivery positions (normal and offset) A, B, C on the sheet delivery tray 42 shown in FIG. 4. When the internal enclosure 61 moves along the direction of the arrow Y in this fashion, the connecting gear 73*a* and the sliding sleeve 74 also move together with the internal enclosure 61. Their movable range (offset width) is limited by the stopper pin 72*a* as already mentioned.

Sheet Delivery Tray

As previously mentioned, the sheet delivery section 40 opens to the exterior on both front and side of the housing of the apparatus 100 without the provision of an upright front wall or an upright pillar at a corner between the front and side of the sheet delivery section 40. This structure ensures high visibility of the inner space of the sheet delivery section 40 and allows easy access to the sheet delivery tray 42. As the length L1 of the sheet delivery tray 42 (as measured along the sheet transport direction) is made smaller than the length L2 of a maximum printable sheet size, a large-sized printed sheet discharged onto the sheet delivery tray 42 sticks out to the exterior as shown in FIG. 1. This arrangement makes it possible to reduce the width of the housing and achieve compact design of the apparatus 100.

Figure 5:
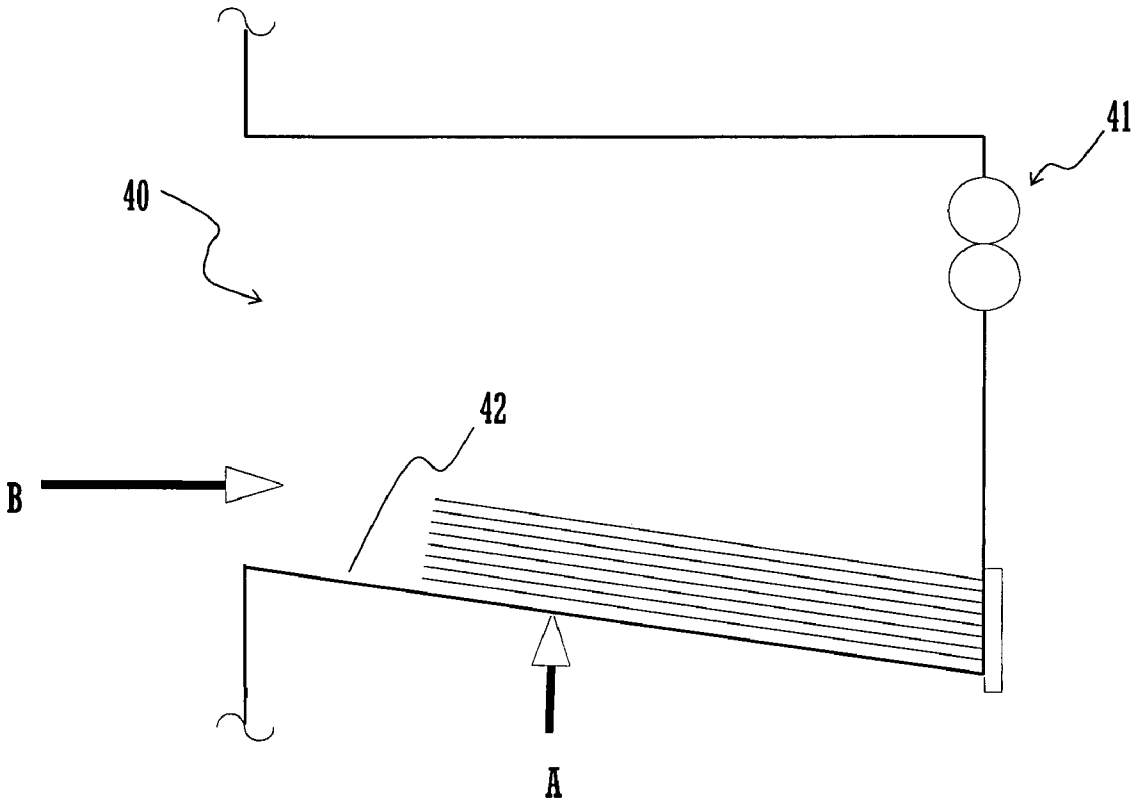
FIG. 5 is a diagram illustrating how small-sized printed sheets are discharged onto the sheet delivery tray.

Since the inner empty space of the housing where the sheet delivery section 40 is located opens to the exterior on one side at a sheet outlet end of the sheet delivery tray 42 as illustrated in FIGS. 1 and 2, the user can easily examine with own eyes printed sheets discharged onto the sheet delivery tray 42. This structure allows the user to easily remove small- and medium-sized printed sheets from either the front or side of the sheet delivery tray 42 as illustrated in FIG. 5 while clearly observing the printed sheets being discharged, thereby offering enhanced ease of handling.

Figure 6:
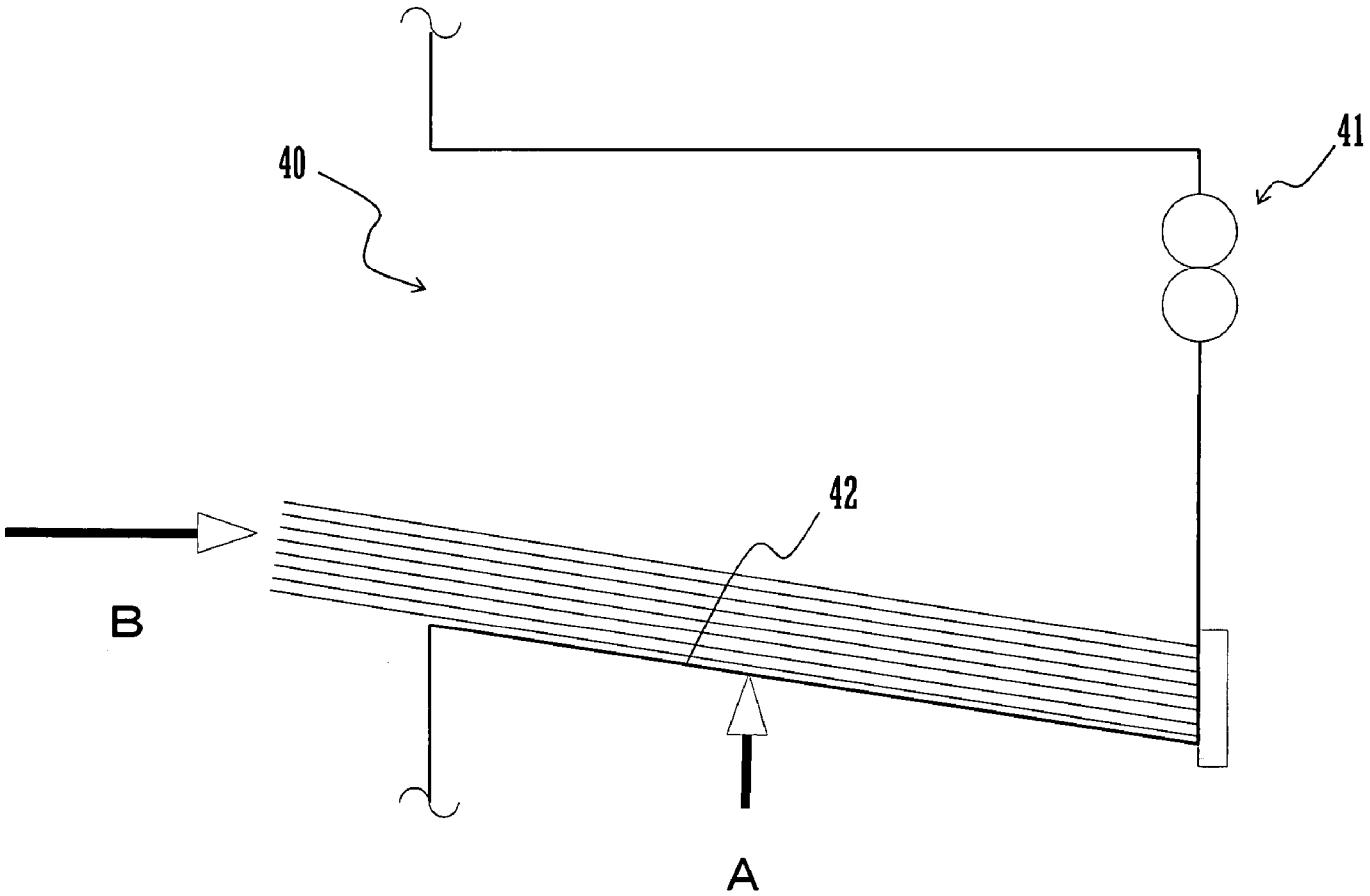
FIG. 6 is a diagram illustrating how large-sized printed sheets are discharged onto the sheet delivery tray.

When printed sheets discharged onto the sheet delivery tray 42 are large-sized, leading edges of the sheets stick out to the exterior as shown in FIG. 6, for example, so that the user can easily observe the sheets from the front of the apparatus 100 and remove the sheets from the side (or front) of the sheet delivery tray 42.

Even when the printed sheets discharged are sorted on the sheet delivery tray 42 by the output sheet shifter mechanism 41, the user can clearly observe the sheets from the side of the sheet delivery tray 42. Furthermore, as it is possible to access the inner space of the sheet delivery section 40 from the side, the user can easily remove sorted copies of the printed sheets by grasping a proper part thereof without inadvertently mixing up the already sorted copies, upon clearly observing the discharged sheets. Thus, the invention eliminate the need for a tedious sorting job.

Figure 7:
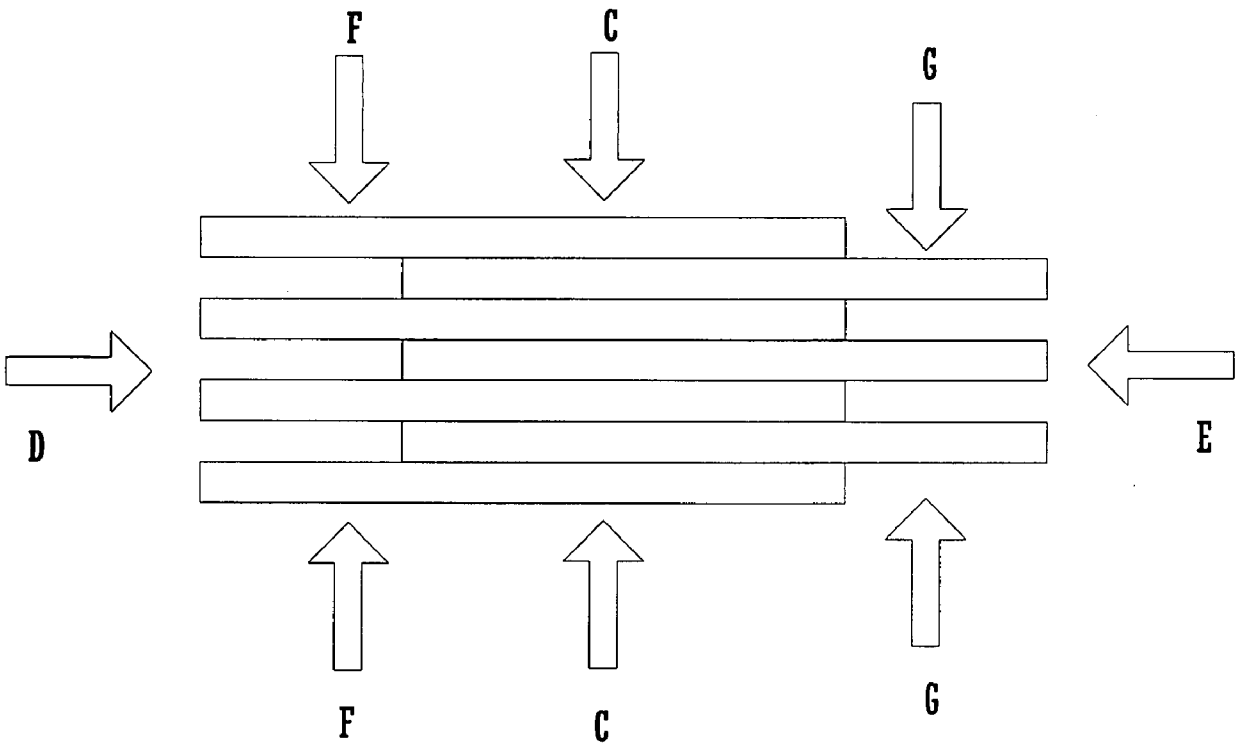
FIG. 7 is a diagram illustrating how sorted copies of printed sheets should be grasped when removing the printed sheets the sheet delivery tray.

When removing copies of the printed sheets sorted on the sheet delivery tray 42 as shown in FIG. 7, for example, it would be possible for the user to grasp the stacked copies in directions shown by outline arrow C—C, D—D, E—E, F—F and G—G. If the user grasps the stacked copies in the directions D—D to G—G, however, the user is likely to mix up the already sorted copies. The user can best remove the printed sheets in a sorted condition by grasping the stacked copies at a central part thereof from top and bottom in the directions C—C without jeopardizing the sorted condition.

Since the sheet delivery section 40 opens to the exterior on one side at the sheet outlet end of the sheet delivery tray 42 in the foregoing embodiment, the user can grasp the stacked copies of the printed sheets in the directions C—C by just stretching the hand to the side of the sheet delivery tray 42 from the front of the apparatus 100 without any difficulty.

The output sheet shifter mechanism 41 of the present embodiment offsets the printed sheets by use of the sheet output rollers 62*a*, 62*b* of the upper and lower offset roller assemblies 62 as stated above. Therefore, the output sheet shifter mechanism 41 does not cause any hindrance to achieving compact design of the image forming apparatus 100. In addition, the user can easily observe and remove the sorted copies of the printed sheets without accidentally mixing up the already sorted copies.

To provide improved sheet stacking performance, the sheet delivery tray 42 is shaped to form a generally horizontal top surface extending perpendicularly to a sheet output direction as show in FIG. 2. Therefore, even if large-sized sheets offset by the output sheet shifter mechanism 41 are discharged onto the sheet delivery tray 42, partially sticking out from the sheet delivery portion, sorted copies of the sheets can be loaded on the sheet delivery tray 42 in a stable fashion. The top surface of the sheet delivery tray 42 may be shaped to extend slightly upslope in the sheet output direction as illustrated in FIGS. 1 and 2.

It should be recognized that the aforementioned sheet delivery mechanism of the invention is applicable not only to the image forming apparatus 100 illustrated in FIG. 1 but also to other types of image forming apparatuses. Specifically, the sheet delivery mechanism of the invention is applicable to any front access type image forming apparatus regardless of its structure or design, only if the apparatus is of a type including an image scanning section located at an upper part of a housing of the apparatus for scanning an original to obtain image information therefrom, a sheet feeding section located at a lower part of the housing for feeding sheets used for image forming, and an image forming section disposed between the image scanning section and the sheet feeding section at one side of the housing, in which the image scanning section, the image forming section and the sheet feeding section are arranged generally in a U shape in cross section in the housing.

The invention being thus described, it will be obvious that the same may be varied in many ways. Such variations are not to be regarded as a departure from the spirit and scope of the invention, and all such modifications as would be obvious to one skilled in the art are intended to be included within the scope of the invention.

What is claimed is:

1. An image forming apparatus comprising:

an image scanning section located at an upper part of a housing of the apparatus for scanning an original to obtain image information therefrom;

a sheet feeding section located at a lower part of the housing for feeding sheets used for image forming;

an image forming section disposed between the image scanning section and the sheet feeding section at one side of the housing; and a shifter mechanism incorporating sheet output rollers which are used as offset rollers for offsetting printed sheets along a direction perpendicular to a sheet transport direction to selectively discharge the printed sheets to different sheet delivery positions on the sheet delivery portion, wherein the image scanning section, the image forming section and the sheet feeding section are arranged generally in a U shape in cross section in the housing, the sheet delivery portion being formed in an inner empty space of the housing just between the image scanning section and the sheet feeding section, and wherein one side and the front of the inner empty space are contiguously open to the exterior of the apparatus, without any structure obstructing the front or the one side of the inner empty space, allowing a user to grasp and remove the discharged printed sheets from either the front or the one side of the apparatus, and wherein the length (L1) of the sheet delivery portion as measured along the sheet transport direction is made smaller than the length (L2) of a maximum printable sheet size, and wherein the sheet output rollers are disposed between the image forming section and the inner empty space.

2. The image forming apparatus according to claim 1, wherein said shifter mechanism includes:

an offset unit mounted in the apparatus movably along the direction perpendicular to the sheet transport direction, the offset unit including the offset rollers for ejecting the printed sheets;

an offsetting force generator for shifting the offset unit along the direction perpendicular to the sheet transport direction;

a driving force transmission part connected to the offset rollers; and a roller turning force generator for turning the driving force transmission part.

3. The image forming apparatus according to claim 1, wherein the sheet delivery portion is shaped to form a generally horizontal sheet receiving surface extending in a direction perpendicular to a sheet output direction.

* * * * *